US005826658A

United States Patent [19]

Harthorn et al.

[11] Patent Number: 5,826,658

[45] Date of Patent: Oct. 27, 1998

[54] RISER FILL-UP VALVE

[75] Inventors: Larry Keith Harthorn; Tan Hoon Kiang; Goi Kim Kok; See Teck Kiat; Lee Yew Huat; Tan Hock Lye, all of Singapore, Singapore

[73] Assignee: ABB Vetco Gray Inc., Houston, Tex.

[21] Appl. No.: 678,337

[22] Filed: Jul. 11, 1996

[51] Int. Cl.[6] ..... E21B 17/01; E21B 33/038; E21B 34/06

[52] U.S. Cl. ..... 166/339; 137/81.2; 166/319; 166/367; 251/145

[58] Field of Search ..... 166/319, 321, 166/324, 339, 367, 386; 137/81.2; 251/145

[56] References Cited

U.S. PATENT DOCUMENTS

| | | | |
|---|---|---|---|
| 4,187,876 | 2/1980 | Lang | 166/319 X |
| 4,210,208 | 7/1980 | Shanks | 166/367 X |
| 4,294,284 | 10/1981 | Herd | 137/81.2 X |
| 4,442,902 | 4/1984 | Doremus et al. | 166/374 |
| 4,621,655 | 11/1986 | Roche | 166/320 X |
| 4,828,024 | 5/1989 | Roche | 166/84 |
| 4,832,126 | 5/1989 | Roche | 166/319 X |
| 5,192,051 | 3/1993 | Roberson . | |
| 5,415,237 | 5/1995 | Strattan | 166/324 X |

*Primary Examiner*—George A. Suchfield
*Attorney, Agent, or Firm*—James E. Bradley

[57] ABSTRACT

A fill-up valve is provided for a riser having a longitudinal axis that is connected at one end to a subsea wellhead and at the other end to a platform of an offshore oil or gas well. The fill-up valve is formed from a gate valve that mounts to an exterior of the riser and occupies a position extending less than the entire transverse periphery of the riser. The gate valve has a transverse profile projecting outward from the exterior of the riser that allows passage of the riser and fill-up valve through confined areas, such as through a rotary table of the well. A flow passage of the gate valve communicates with the interior of the riser to allow water to flow into the interior of the riser.

14 Claims, 3 Drawing Sheets

RISER FILL-UP VALVE

BACKGROUND OF THE INVENTION

1. Field of the Invention

This invention relates in general to offshore oil and gas well equipment and in particular to a fill-up valve for a subsea riser to allow the inflow of sea water into the riser to prevent its collapse or damage as a result of a drop in the internal pressure of the riser.

2. Description of the Prior Art

In offshore oil and gas wells, a pipe, often referred to as a riser, is used for communicating between the wellhead, located at the sea bottom, and the surface platform. Because of the extreme hydrostatic pressure exerted by the surrounding sea water in many offshore oil and gas wells, drops in pressure within the riser, such as occurs if there is a sudden loss of drilling fluid or from formation gases entering the riser, may cause the riser to collapse. In cases where formation gas enters the riser, the dangerous situation may occur where the riser is buoyed towards the surface, resulting in damage to the well and platform and endangering persons in the area. To prevent this from occurring, fill-up valves have been used to allow sea water to flow into the riser to help equalize the pressure between the interior and exterior of the riser.

It is often necessary to pass the riser through very confined spaces, such as through the rotary table, during "tripping" of the riser. This means that the fill-up valve must have a low enough profile to prevent interference of the valve on structures as the riser is raised or lowered through the well platform. To this end, most prior art fill-up valves employ a cylindrical sleeve that fits closely around the riser to cover ports in the riser. The sleeve is then raised or lowered to open or close the ports, allowing or preventing sea water from flowing into the riser. Because the risers may be several feet in diameter, and the valve fits around the entire circumference of the riser, the sleeve-type valve is usually very heavy, requiring large amounts of force to lift the valve to uncover the ports. The large interfacing surface area of the valve sleeve with the exterior of the riser adds to the frictional forces that must be overcome and increases the chance of binding or seizing of the sleeve with the riser.

Gate valves are commonly fitted on pipes and other fluid conduits to regulate the flow of fluid therethrough. Gate valves are provided with a disk or other structure that fits tightly within the flow passage of the pipe or conduit to which it is fitted. This structure serves as a gate that can be lifted or lowered into the flow passage of the pipe to stop the flow of fluid. Gate valves are fairly simple in design and provide a reliable means for regulating the flow of fluid within the pipe or conduit. Because most gate valves tend to be rather bulky, they are very commonly used in applications where space is not necessarily a concern. As a result of their size, however, gate valves have not been used as fill-up valves on risers of offshore oil and gas wells.

SUMMARY OF THE INVENTION

A fill-up valve is provided for a riser having a longitudinal axis that is connected at one end to a subsea wellhead and at the other end to a platform of an offshore oil or gas well. The fill-up valve is formed from a gate valve that mounts to an exterior of the riser and occupies a position extending less than the entire transverse periphery of the riser. The gate valve has a transverse profile projecting outward from the exterior of the riser that allows passage of the riser and fill-up valve through confined areas, such as through a rotary table of the well. A flow passage of the gate valve communicates with the interior of the riser to allow water to flow into the interior of the riser.

DETAILED DESCRIPTION OF THE INVENTION

Figure 1:
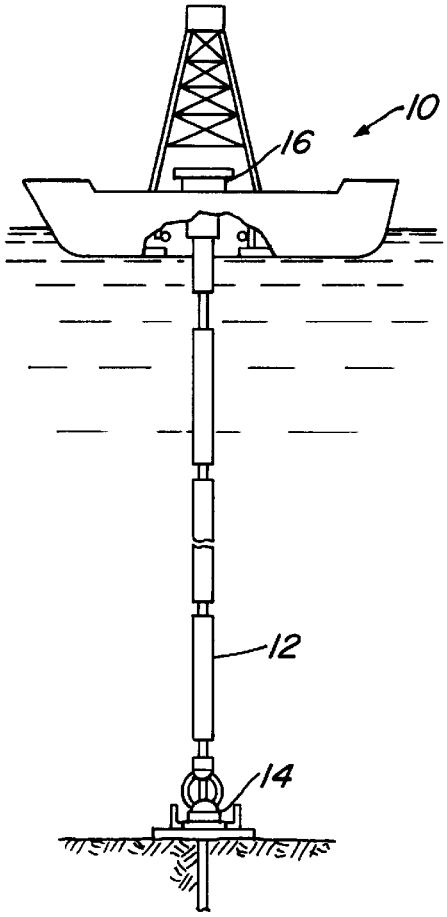
FIG. 1 is a side view of an offshore platform of an oil or gas well shown with a riser extending from the platform to a subsea wellhead.

Referring now to the figures, FIG. 1 shows an offshore well platform designated generally at 10 used in the production or drilling of oil and gas wells. A riser 12 is connected at its lower end to a wellhead 14 located on the sea floor, and at its upper end to a surface wellhead or Christmas tree 16 of the platform 10. The riser 12 is formed from sections of pipe that are joined together at the ends.

Figure 2:
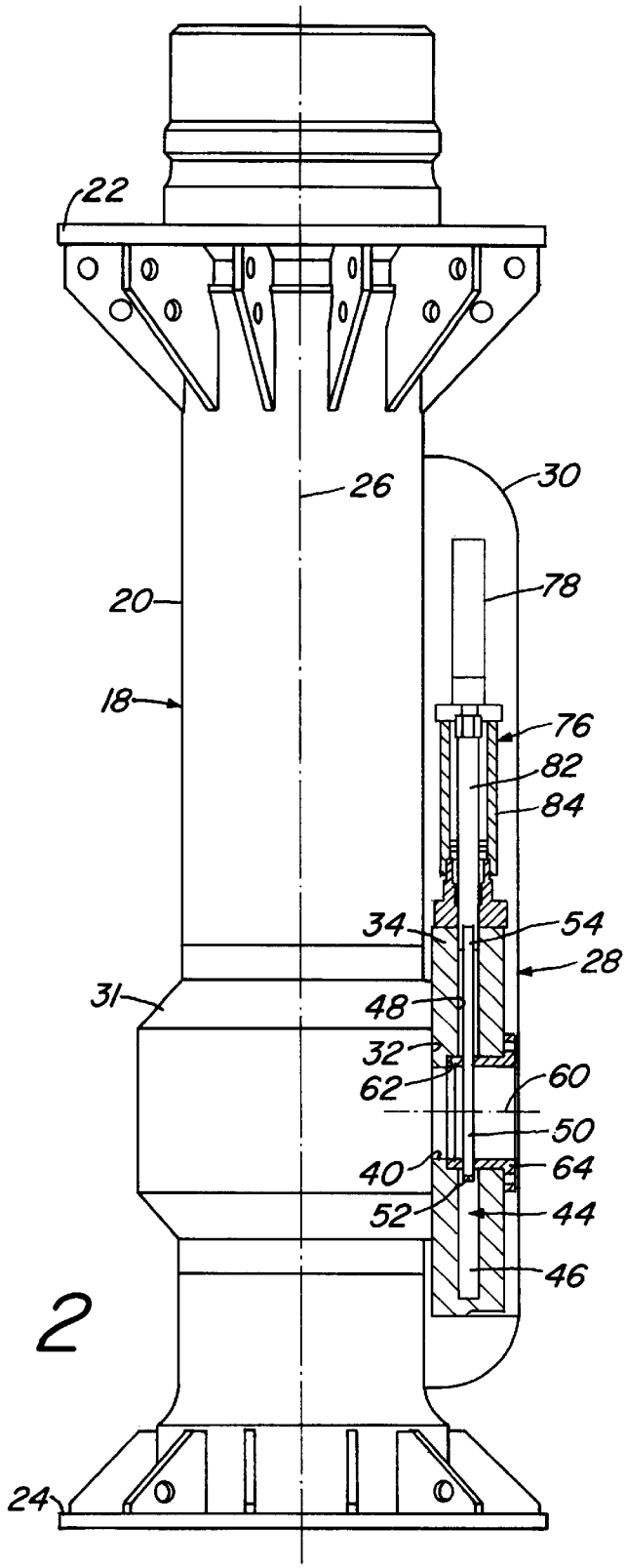
FIG. 2 is a side view of a fill-up valve of the invention shown attached to a riser joint, with the fill-up valve shown in cross section.

FIG. 2 shows a riser joint 18 that forms a portion of the riser 12. The riser joint 18 has a generally cylindrical midsection 20 and opposite mounting flanges 22, 24 on either end of the midsection 20 for mounting to other sections of pipe forming the riser 12. A longitudinal axis 26 of the riser 12 runs through the center of the riser joint 18. As can be seen, the mounting flanges 22, 24 project radially outward a distance from the exterior of the midsection 20.

Figure 4:
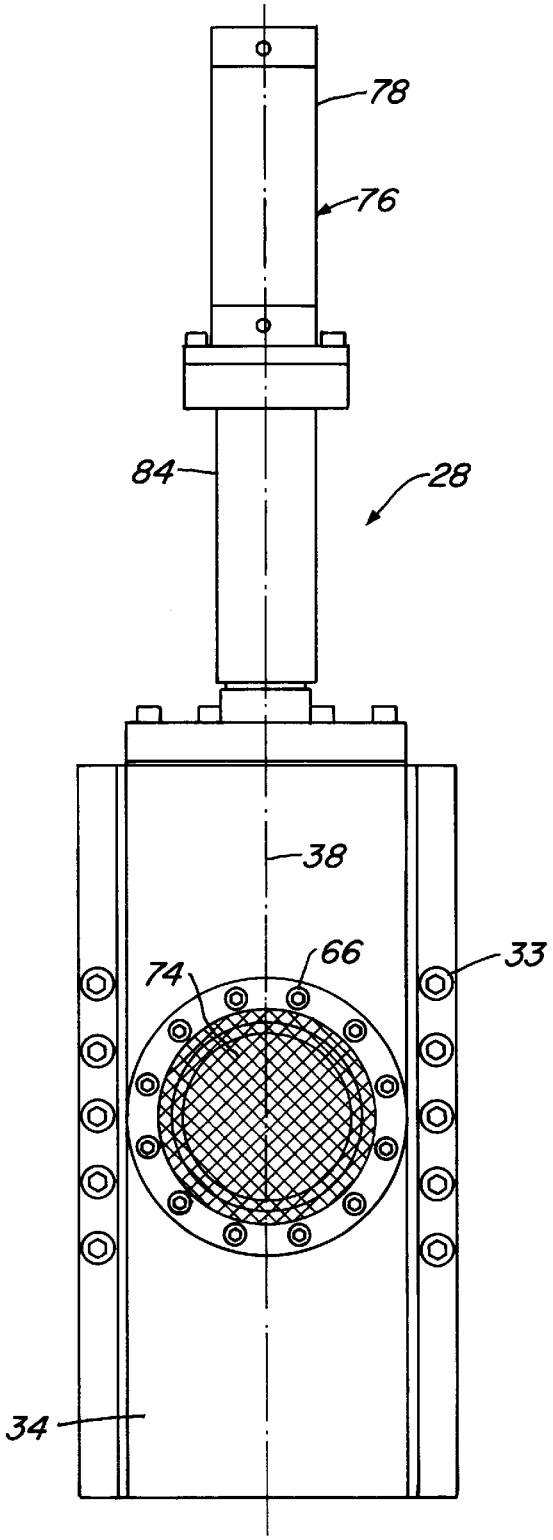
FIG. 4 is a front elevational view of the fill-up valve of FIG. 3.

Mounted to the exterior of the midsection 20 is a fill-up valve 28. While only one valve 28 is shown, the joint 18 can be fitted with more than one valve. The fill-up valve 28 is formed from a gate valve that occupies a position on the exterior of the midsection 20 that is less than the entire circumference of the midsection 20. The gate valve 28 is enclosed within a protective housing 30. The gate valve 28 may be attached to the riser joint 18 by providing an intermediate forging or thickened area 31 having a milled-flat surface or flange 32 with bolt holes (not shown) formed therein to allow the gate valve 28 to be bolted thereto with bolts 33 (FIG. 4).

Figure 5:
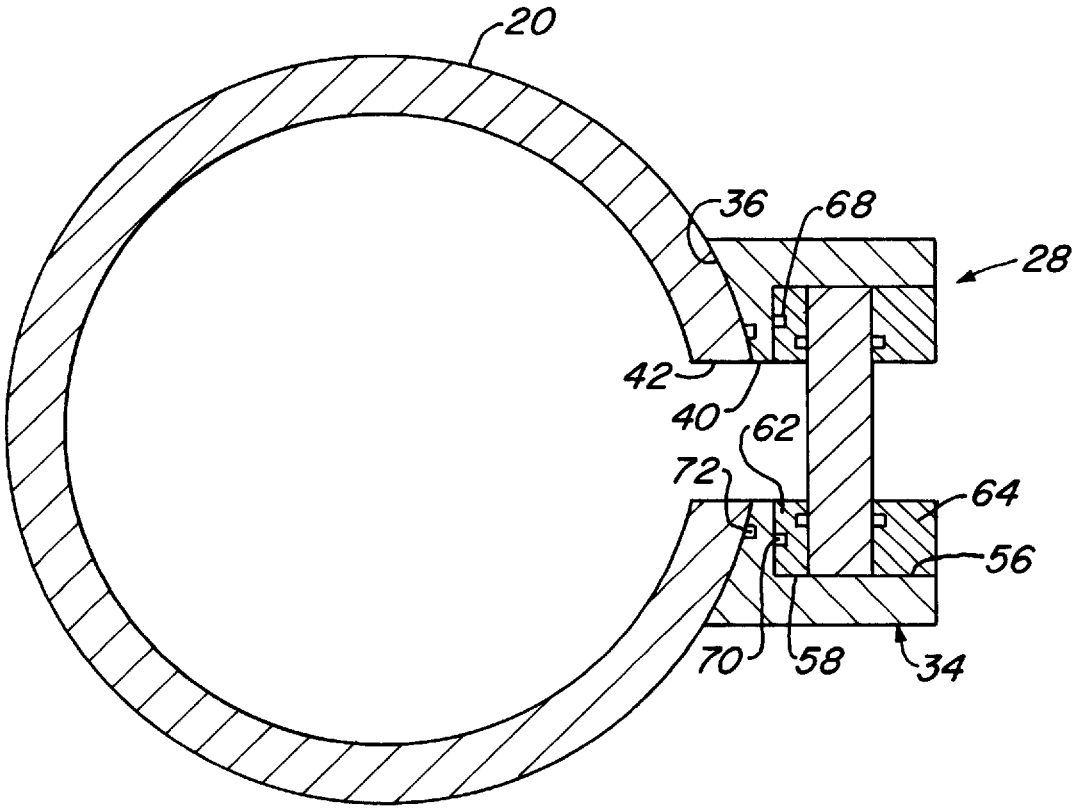
FIG. 5 is transverse cross-sectional view of the fill-up valve shown attached to a riser and constructed in accordance with the invention.

The gate valve 28 is formed from a valve body 34 that has an arcuate surface 36 (FIG. 5) corresponding to the cylindrical outer surface of the midsection 20 for close engagement therewith. The valve body 34 is oriented so that the longitudinal axis 38 of the valve 28 and valve body 34 is parallel to the longitudinal axis 26 of the riser 12.

A flow passage 40 formed in the valve body 34 extends radially outward from the exterior of the midsection 20 and transverse to the axis 38. The flow passage 40 is in fluid communication with a port 42 formed in the wall of the midsection 20, which opens into the interior of the riser 12. A gate chamber 44 is formed in the valve body 34 and extends generally parallel with the longitudinal axis 38, intersecting the flow passage 40. The gate chamber 44 is divided into a lower chamber 46, which extends below the passage 40, and an upper chamber 48 extending above the passage 40.

Figure 3:
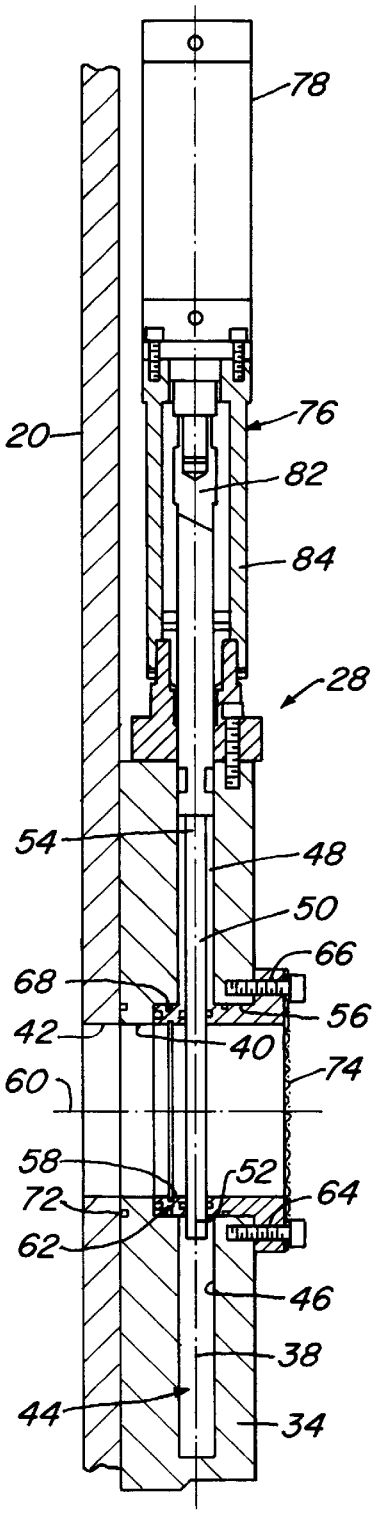
FIG. 3 is an enlarged cross-sectional side view of the fill-up valve of FIG. 2.

A gate 50 locates within the gate chamber 44. The gate 50 has a lower end 52 and an upper end 54. The gate 50 is movable within the gate chamber 44 between shut and open positions. When in the shut position, the gate 50 extends downward through the upper chamber 48 and across the flow passage 40, with the lower end 52 of the gate 50 projecting a distance into the lower chamber 46, as shown in FIG. 3. When in the open position, the gate 50 locates within the upper chamber 48 with the lower end 52 of the gate 50 clearing the flow passage 40.

A counterbore 56 is formed in the flow passage 40 extending inward from the exterior of the valve body 34. The counterbore 56 terminates on the inward side of the intersecting gate chamber 44 to define a shoulder 58. The shoulder 58 is perpendicular to the axis 60 of the flow passage 40. An inner seat 62 locates within the counterbore 56 between the gate chamber 44 and shoulder 58. An outer seat 64 is positioned in the counterbore 56 on the outward side of the gate chamber 44 and secured to the valve body 34 by means of bolts 66. For ease of assembly and disassembly, inner seat 62 and outer seat 64 are designed to be installed and removed in a transverse direction. Outer seat 64 is removed by unscrewing bolts 66. Then inner seat 62 can be accessed when outer seat 64 and gate 50 are removed.

Seals 68 (FIG. 5) locate within annular grooves 70 of the inner and outer seats 62, 64 at the interfaces of the gate 50 and flow passage 40 to prevent the entry of fluid into the gate chamber 44. Likewise, an annular groove and seal 72 are formed in the valve body 44 around the flow passage 60 at the interface of the valve body 44 with the exterior of the midsection 20.

A screen 74 mounts over the opening of flow passage 40 and is bolted to the outer seat 64 by means of the bolts 66 to prevent entry of foreign objects into the riser 12 when the valve 28 is opened.

Actuating means designated generally at 76 is provided for lifting and lowering the gate 50 between the open and shut positions. The actuating means 76 may be a pressure differential type actuator that opens and shuts the gate 50 in response to a preselected pressure difference between the interior and the exterior of the riser 12. In the embodiment shown, the actuating means consists of a manually operated hydraulic cylinder 78 having a piston (not shown) disposed therein. A piston shaft or rod 82 is joined to the piston, extending downward through a shaft housing 84 from the cylinder 78, and is joined at its lower end to the upper end 54 of the gate 50. The hydraulic piston and cylinder 76 has fluid lines (not shown) for pressurizing the cylinder from the surface, to thus open and shut the gate 50.

The operation of the fill-up valve 28 is as follows. As can be seen from FIG. 3, the fill-up valve 28 is attached to the riser joint 18 so that it can be mounted to other sections of pipe forming the riser string. The valve 28 and housing 30 have a small profile that does not project transversely from the exterior of the midsection 20 any further than the mounting flanges 22, 24. Thus, when the riser 12 is passed through the platform 10 at the surface, the valve 28 does not catch or interfere with surrounding structures as the riser string is raised or lowered into position.

With the joint 18 mounted in the riser string 12, in normal operation the gate 50 will be in the shut position so that the passage 40 is effectively closed off, preventing the flow of sea water into the port 42. Sensors may be placed inside and outside the riser 12 to monitor pressure differences. If the pressure difference becomes too great, such as occurs when there is a loss of drilling fluid or from gas entering the riser 12 from the formation, the valve 28 may be actuated. This is accomplished by manually actuating the piston and cylinder 76 from the surface so that the gate 50 is moved to the open position. This allows sea water to flow through the passage 40, through port 42 and into the interior of the midsection 20, which is in communication with the remainder of the riser 12. The pressure between the exterior and interior of the riser is thus equalized. The gate 50 is then shut to prevent further inflow of sea water into the riser 12.

There are many advantages to the fill-up valve of the invention utilizing the gate valve. The gate valve has a low transverse profile that makes it easy to pass through confined areas, such as through the rotary table of the well. The gate valve is simple in construction and because the gate does not extend around the entire circumference of the riser, the gate is lighter and much easier to move between the open and shut positions. There is less chance of the gate binding or seizing because of its smaller surface area. It is also much easier to provide a sealing engagement of the gate with the valve seats and the stationary valve body with the exterior of the riser, than it is with the sleeve-type valve. The valve can be easily removed and replaced by simply unbolting the valve. If necessary, the port in the riser joint can be plugged if the valve is not required.

While the invention has been shown in only one of its forms, it should be apparent to those skilled in the art that it is not so limited, but is susceptible to various changes without departing from the scope of the invention.

We claim:

1. A fill-up valve for a riser having a longitudinal axis connected at one end to a subsea wellhead and at the other end to a platform of an offshore oil or gas well, the fill-up valve comprising:

a gate valve that mounts to an exterior of the riser and occupying a position extending less than the entire transverse periphery of the riser, the gate valve having a transverse profile projecting outward from the exterior of the riser that allows passage of the riser and fill-up valve through confined areas, and the gate valve having a flow passage that communicates with the interior of the riser.

2. The fill-up valve of claim 1, wherein:

the gate valve is mounted to a midsection of a riser joint having a mounting flange located on at least one end of the midsection for coupling to other portions of the riser so that the riser joint forms a section of the riser.

3. The fill-up valve of claim 2, wherein:

the gate valve projects outward from the midsection; and at least a portion of the mounting flange having a transverse profile that overlaps the transverse profile of the gate valve.

4. The fill-up valve of claim 1, wherein the gate valve comprises:

a valve body configured to mount to the riser, the valve body having a longitudinal axis that is parallel to the longitudinal axis of the riser, the flow passage being formed in the valve body, the valve body having a gate chamber extending generally parallel to the longitudinal axis of the valve body and intersecting the flow passage;

a valve seat positioned at the intersection of the chamber with the flow passage;

a gate locating within the gate chamber, the gate being movable between open and shut positions within the gate chamber past the valve seat, and wherein the gate blocks the flow passage when in the shut position to prevent the passage of fluid therethrough; and gate actuating means for moving the gate between the open and shut positions.

5. The fill-up valve of claim 4, wherein:

the actuating means includes a hydraulic actuator.

6. The fill-up valve of claim 1, wherein:

the valve seat has seal means to prevent entry of fluid into the gate chamber from the fluid passage.

7. A fill-up valve and riser joint combination for a riser formed from sections of pipe, the riser being connected at one end to a subsea wellhead and at the other end to a platform of an offshore oil or gas well, the fill-up valve mounting along an exterior of the riser and having a profile that allows passage of the riser and fill-up valve through confined areas, the fill-up valve and riser joint combination comprising:

a riser joint having a generally cylindrical midsection and a mounting flange located on at least one end of the midsection for mounting to the sections of pipe forming the riser, the midsection forming a portion of the riser and defining an interior thereof; and a gate valve mounted to midsection of the riser joint, the gate valve occupying a position extending circumferentially less than the entire circumference of the midsection, the gate valve having a flow passage in communication with the interior of the midsection to allow the inflow of sea water into the riser.

8. The combination of claim 7, wherein:

the gate valve projects radially outward from the midsection; and at least a portion of the mounting flange radially overlaps the gate valve.

9. The combination of claim 7, wherein the gate valve comprises:

a valve body mounted to the midsection, the valve body having a longitudinal axis that is parallel to the length of the midsection, the flow passage being formed in the valve body, the valve body having a gate chamber extending generally parallel to the longitudinal axis of the valve body and intersecting the flow passage;

a valve seat positioned at the intersection of the chamber with the flow passage;

a gate locating within the gate chamber, the gate being movable between open and shut positions within the gate chamber past the valve seat, and wherein the gate blocks the flow passage when in the shut position to prevent the passage of fluid therethrough; and gate actuating means for moving the gate between the open and shut positions.

10. The combination of claim 9, wherein:

the actuating means includes a hydraulic actuator.

11. The combination of claim 9, wherein:

the valve seat has seal means to prevent entry of fluid into the gate chamber from the fluid passage.

12. A fill-up valve for a riser that is connected at one end to a subsea wellhead and at the other end to a platform of an offshore oil or gas well, the fill-up valve mounting along an exterior of the riser and having a transverse profile that allows passage of the riser and fill-up valve through confined areas, the fill-up valve comprising:

a valve body configured to mount to the riser over an area extending less than the entire transverse periphery of the riser, the valve body having a longitudinal axis that is parallel to a longitudinal axis of the riser, the valve body having an inner side and an outer side, and a flow passage that is in communication with the interior of the riser and extends through the inner and outer sides, the valve body having a gate chamber extending generally parallel to the longitudinal axis of the valve body and intersecting the flow passage;

inner and outer valve seats positioned at the intersection of the chamber with the flow passage, one on each side of the chamber;

a gate locating within the gate chamber, the gate being movable between open and shut positions within the gate chamber between the valve seats, and wherein the gate blocks the flow passage when in the shut position to prevent the passage of fluid therethrough; and actuating means for moving the gate between the open and shut positions.

13. The fill-up valve of claim 12, wherein:

the actuating means includes a hydraulic actuator.

14. The fill-up valve of claim 12, further comprising:

fastening means secured to the outer side of the body for securing the outer seat in the flow passage, the fastening means when removed allowing the outer seat and then the inner seat to be withdrawn from the body by lateral outward movement through the flow passage.

* * * * *